United States Patent [19]

Gotoh

[11] Patent Number: 4,658,865

[45] Date of Patent: Apr. 21, 1987

[54] LOOM EQUIPPED WITH WEFT PICKING CONTROL SYSTEM

[75] Inventor: Miyuki Gotoh, Tokyo, Japan

[73] Assignee: Nissan Motor Co., Ltd., Yokohama, Japan

[21] Appl. No.: 757,948

[22] Filed: Jul. 23, 1985

[30] Foreign Application Priority Data

Jul. 24, 1984 [JP] Japan ..... 59-151981

[51] Int. Cl.[4] ..... D03D 47/30; D03D 47/36

[52] U.S. Cl. ..... 139/435; 139/452

[58] Field of Search ..... 139/435, 452, 450

[56] References Cited

U.S. PATENT DOCUMENTS

| | | | |
|---|---|---|---|
| 4,446,893 | 5/1984 | Gunneman et al. | 139/11 |
| 4,458,726 | 7/1984 | Wenig | 139/435 |
| 4,463,783 | 8/1984 | Suzuki et al. | 139/435 |
| 4,471,817 | 9/1984 | Brouwer | 139/452 |
| 4,527,598 | 7/1985 | Walch | 139/435 |
| 4,573,499 | 3/1986 | Sugita et al. | 139/435 |
| 4,595,039 | 6/1986 | Thouander | 139/435 |

FOREIGN PATENT DOCUMENTS

| | | | |
|---|---|---|---|
| 155697 | 3/1984 | Japan | 139/435 |
| 013904 | 8/1985 | Japan | 139/435 |
| 016973 | 8/1985 | Japan | 139/435 |

*Primary Examiner*—Werner H. Schroeder
*Assistant Examiner*—Joseph S. Machuga
*Attorney, Agent, or Firm*—Schwartz, Jeffery, Schwaab, Mack, Blumenthal & Evans

[57] ABSTRACT

A fluid jet loom has a weft inserting nozzle and is equipped with a weft picking control system including means for measuring a weft picking time period for accomplishing a weft picking. The difference between the measured weft picking time period and a standard value in each weft picking is computed, and a plurality of such differences are accumulated to obtain an accumulated value. The accumulated value is compared with an allowable limit to judge as to whether the accumulated value exceeds the allowable limit or not. Upon judgement of the accumulated value exceeding the allowable limit, the air pressure to be supplied to the weft inserting nozzle is controllably changed to regulate the weft picking time period at a suitable value, thereby achieving an optimum weft picking control.

21 Claims, 14 Drawing Figures

LOOM EQUIPPED WITH WEFT PICKING CONTROL SYSTEM

BACKGROUND OF THE INVENTION

1. Field of the Invention

This invention relates generally to an improvement in a loom equipped with a weft picking control system, and more particularly to the weft picking control system arranged to control weft picking in an optimum condition.

2. Description of the Prior Art

A variety of weft picking control systems of looms have been proposed to attain good weft picking. One of these is disclosed, for example, in U.S. Pat. No. 4,446,893 entitled "Method for Transporting a Weft Thread through the Weaving Shed of a Weaving Machine through the Intermediary of a Flowing Fluid, and Weaving Machine adapted for the Application of this Method". The weft picking control system in this U.S. patent is arranged as follows: A weft yarn is picked into the shed of warp yarns under the influence of tranporting fluid ejected from a plurality of nozzles, in which the transporting speed or time of the picked weft yarn is measured by detecting a timing at which the tip end of the weft yarn reaches an anti-weft picking side from a timing of starting of weft picking. The revolution speed of a main shaft of the loom or the transporting speed of the weft yarn is controlled in such a manner that the measured time occupies a predetermined fraction of time in a weaving cycle. This is effective for reducing mispick.

Now, if weft picking conditions are the same and weft yarns are the same in character, time periods required for weft pickings are theoretically the same. However, in practice, there arise differences in weft picking time periods among a plurality of weft pickings. In this regard, weft picking is not necessarily accomplished in a optimum condition even by controlling a fluid to be supplied to a weft inserting nozzle or by controlling the revolution speed of a main shaft of the loom upon comparing the weft picking time period for each pick with a standard value. In view of this, with the arrangement of the above-mentioned U.S. patent, the weft picking time periods of a plurality of weft pickings are averaged to obtain an average value, and the weft picking control is made in accordance with the average value, thereby preventing drawbacks due to the differences in weft picking time period among a plurality of weft pickings.

However, in such a weft picking control made in accordance with the average of a plurality of weft picking time periods, the control of the fluid to be supplied to the weft inserting nozzle or the control of the loom main shaft revolution speed cannot be carried out until a plurality of weft pickings are completed. Accordingly, even when a significant change in loom operation is made (for example, a weft package is changed to another one in which an empty winding state is changed to a full winding state thereby requiring a large weft picking force), the weft picking cannot be changed until a plurality of weft pickings have been completed, thus arises a shortage in weft picking forces which may lead to stopping of loom operation. This hinders effective weft picking control.

Otherwise, it has been proposed to make a similar control by obtaining, for each pick, an average value of a plurality of previous weft picking time periods assuming the present time as a standard. However, the speed of calculation is not high and therefore the control cannot follow the revolution of the loom, thus making it impossible to put it into practical use.

SUMMARY OF THE INVENTION

A first aspect of the present invention resides, as illustrated in FIG. 11A, in a fluid jet loom equipped with a weft picking control system including a weft picking force measuring means A for measuring a force applied to a weft yarn to be picked from a weft inserting nozzle for the purpose of accomplishing a weft picking. A computing and accumulating means B is provided to compute differences each between the force and a standard value and to accumulate the differences to obtain an accumulated value. A comparing and judging means C is provided to compare the accumulated value with an allowable limit and to judge as to whether the accumulated value exceeds the allowable limit or not. Additionally, a control means D is provided to controllably change a condition under which the weft yarn is picked, upon judgement that the accumulated value exceeding the allowable limit.

Accordingly, with this configuration, weft picking control is so made as to smoothly change the weft picking condition upon judgement of the difference between the measured force and the standard value becoming large, making the judgement by using a plurality of picks for the purpose of making the control stable. By this, if the difference is large, the change in weft picking condition can be made even in a case where the number of picks has still been small. Thus, the weft picking control can smoothly follow a sudden significant loom operation change such as weft package changing, thereby achieving optimum weft picking control.

A second aspect of the present invention resides, as illustrated in FIG. 11B, in the fluid jet loom equipped with a weft picking control system similar to that of the first aspect with the exception that the control means includes a control value computing means E for carrying out an operation in accordance with the following equation upon the judgement the accumulated value exceeding the allowable limit:

$$V_1 = V_2 \pm V_2/\Sigma P$$

where $V_1$ is a first control value representative of the force; $V_2$ is a second control value representative of the force and used earlier in time than said first control value, so that the weft picking condition is controllably changed in accordance with the control value $V_1$ by a control means D'.

Accordingly, with this configuration, the number of picks whose accumulated value exceeds the allowable limit is used for weft picking control so that the control can be made in accordance with the magnitude of the difference between the force and the standard value, thus achieving the weft picking in a more optimum condition.

BRIEF DESCRIPTION OF THE DRAWINGS

The features and advantages of the loom of the present invention will be more clearly appreciated from the following description taken in conjunction with the accompanying drawings in which like reference numerals designate corresponding elements and parts, and in which.

DETAILED DESCRIPTION OF THE INVENTION

Figure 1:
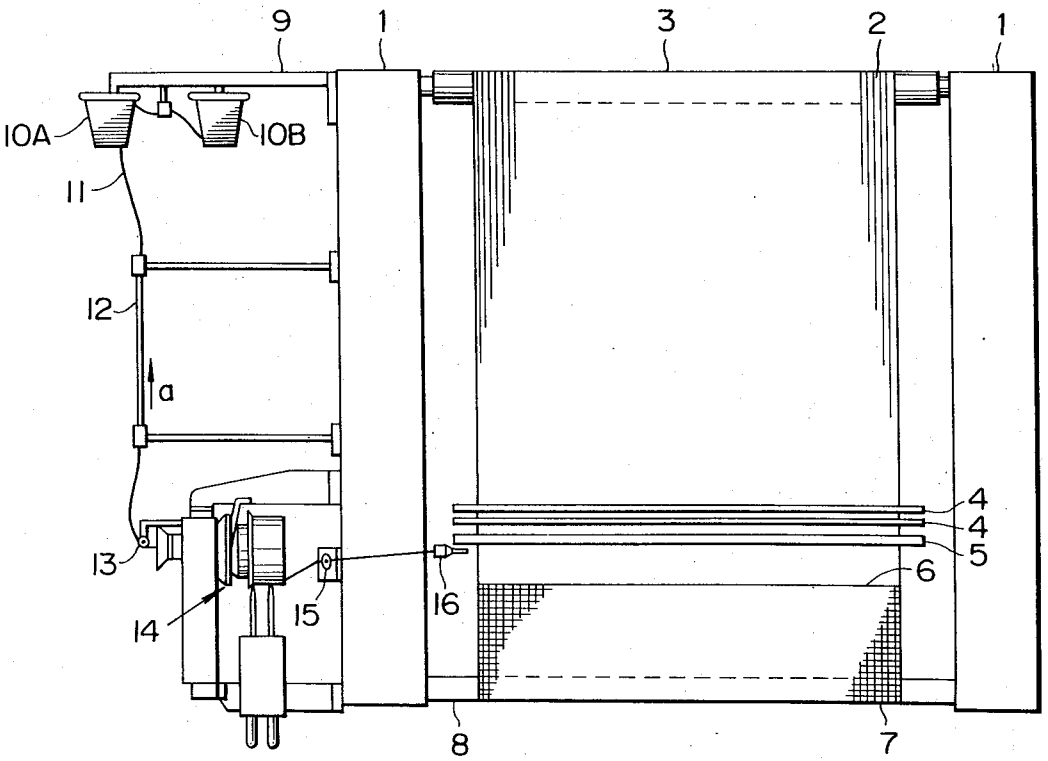
FIG. 1 is a plan view of a first embodiment of a loom of the present invention.

Referring now to FIG. 1, there is shown a first embodiment of a fluid jet loom of the present invention. The loom consists of frames 1, 1′ on which a back roller 3 is rotatably supported. Warp yarns 2 are being passed on the back roller 3 and extend through healds 4 and a reed 5 to form a cloth fell 6 from which a woven cloth 7 extends through a breast beam 8 to a take-up motion (not shown). Weft packages 10A, 10B are supported by a package holder 9 which is fixed to the frame 1. A weft yarn 11 drawn off from the package 10A is being passed through an air tensor 12 in which air stream is produced in the direction of an arrow a, and then is introduced through a guide pulley 13 to a drum type weft storage or detaining device 14 as disclosed, for example, in U.S. Pat. No. 4,378,821 entitled "Weft Detaining Device of Shuttleless Loom". The weft yarn 11 introduced to the weft storage device 14 is wound thereon and thereafter passed through a weft brake or gripper 15 which is adapted to grip and release the weft yarn 11 at predetermined times. The weft yarn 11 from the weft brake 15 is passed through a main or weft inserting nozzle 16 for weft insertion, which nozzle is arranged to swingably move with the reed 5 as a single member.

Figure 2:
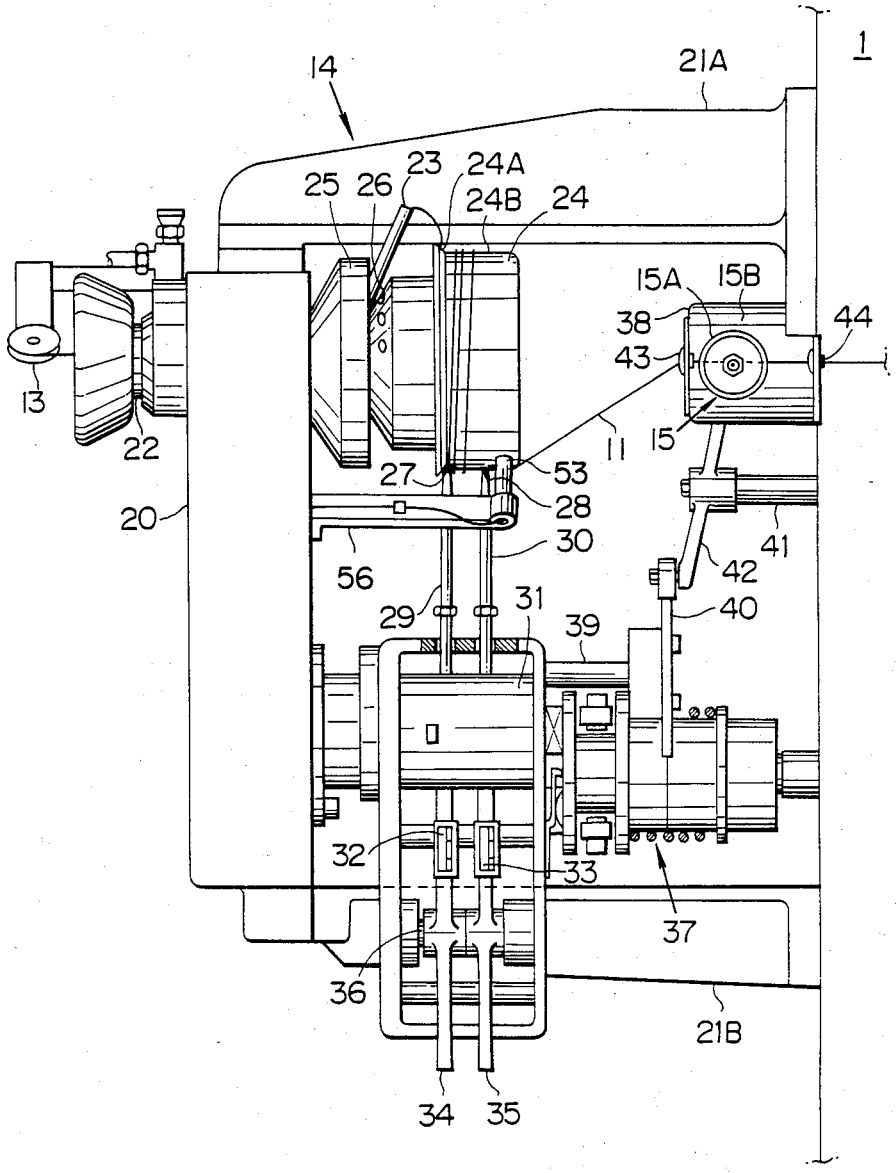
FIG. 2 is a plan view of a part of the loom of FIG. 1, mainly showing a weft storage device and a weft wind-off detector.
Figure 3:
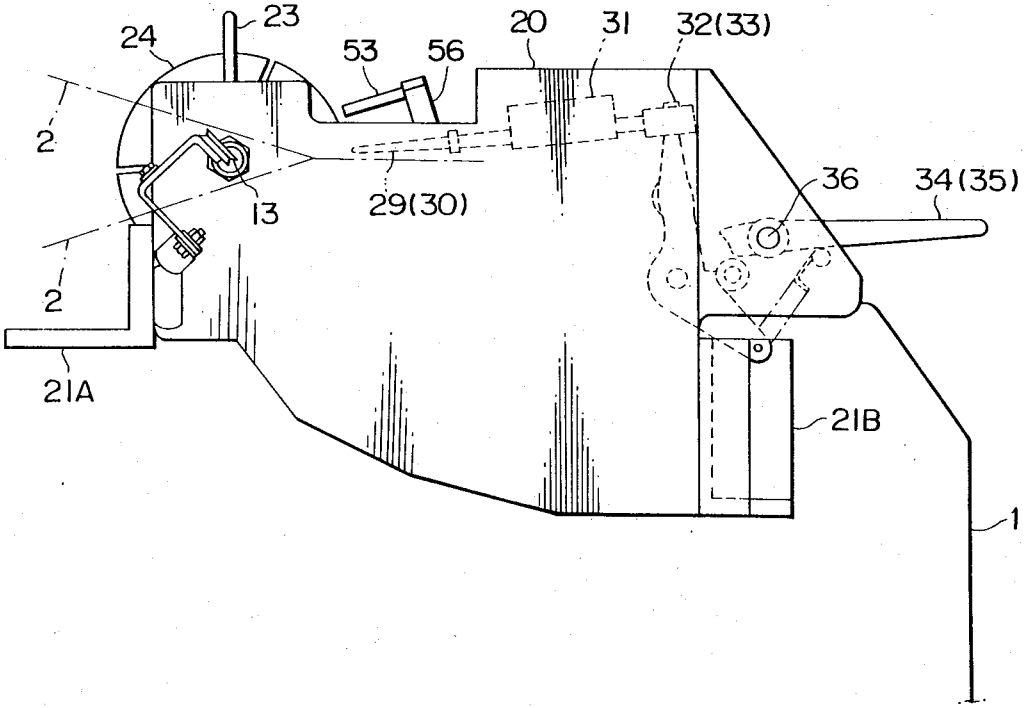
FIG. 3 is a side view of the loom part of FIG. 2, mainly showing the weft storage device.

As shown in FIGS. 2 and 3, a gear box 20 is fixed to stays 21A, 21B projected from the frame 1. A hollow rotatable shaft 22 is rotatably supported by the gear box 20. The roatable shaft 22 is provided with a guide pipe 23 which projects therefrom in the direction away from the axis thereof. A drum 24 is rotatably mounted on one end section of the rotatable shaft 22 in such a manner as to be rotatable relative to the rotatable shaft 22. A magnet holder 25 is secured to the gear box 20 and fixedly provided with magnets (not shown) which face to magnets 26 fixed on the back face of the drum 24, so that the drum 24 is maintained in the stationary state even upon rotation of the rotatable shaft 22. The drum 24 includes a frustoconical winding section 24A on which the weft yarn 11 introduced is wound, and a generally cylindrical detaining section 24B on which the weft yarn 11 moved from the winding section 24A is detained. The drum 24 is formed with a hole 27 located at a border section between the winding section 24A and the detaining section 24B, and a hole 28 located in the detaining section 24B. Engaging pins 29, 30 are movably disposed relative to the holes 27, 28 so that each of them projects into or withdraws from the hole 27, 28. The engaging pins 29, 30 are slidably fitted in a guide member 31 and respectively provided with rectangular sections (not labeled) to which swingable members 32, 33 respectively fit so as to be reciprocally vertically movable as shown in FIG. 3. Levers 34, 35 are rotatably mounted on a spindle 36 and function so as to pull out the engaging pins 29, 30 from the respective holes 27, 28 when manually operated.

A power transmitting device system 37 is provided to transmit power from a main shaft (not shown) of the loom to the gear box 20. A weft brake 15 is fixed to a base 38 which is in turn fixedly connected to the frame 1, and consists of lower and upper grip members 15A, 15B between which the weft yarn 11 lies. The gripping and releasing action of the weft yarn 11 is carried out by contacting and separating the upper grip member 15B relative to the lower grip member 15A under the swingable movement of a lever 42 which is rotatably mounted on a fixed shaft 41. The swingable movement of the lever 42 is made by a cam 40 fixed to a shaft 39 projected from the gear box 20. The reference numerals 43, 44 designate weft guides respectively disposed forward and rearward of the weft brake 15.

With this arrangement, the rotatable shaft 22 rotates together with the guide pipe 23 in timed relation to the main shaft of the loom, so that the weft yarn 11 is wound on the winding section 24A of the drum 24 while the engaging pins 29, 30 project into and withdraw from the holes 27, 28 at the predetermined timings. More specifically, such an operation will be explained assuming the time point of the termination of weft picking as an initial point. First, when the weft picking terminates, the engaging pin 30 gets out of the hole 28 while the engaging pin 29 is projecting in the hole 27, so that the weft yarn 11 is extended to the weft guide 43 so as to take the shortest distance after engaging with the engaging pin 29. Subsequently, the engaging pin 29 projects into the hole 28, and thereafter the engaging pin 29 gets out of the hole 27. As a result, the weft yarn 11 wound on the drum winding section 24A moves onto the detaining section 24B and is then wound thereon at predetermined number of times, for example, four times. Thereafter, the engaging pin 29 projects into the hole 27 to separate the thus wound weft yarn 11 from the weft yarn which will be wound hereinafter. When the time period of weft picking has come, the weft brake 15 releases the weft yarn 11 and the engaging pin 30 gets out of the hole 28, thereby accomplishing the weft picking of the weft yarn 11 under the action of the air injection from the main nozzle 16. At this time, the weft yarn 11 wound on the detaining section 24B is wound off four times and brought into engagement with the engaging pin 29 to complete or terminate the weft picking. Thereafter, the weft yarn 11 is gripped by the weft brake 15.

Figure 4:
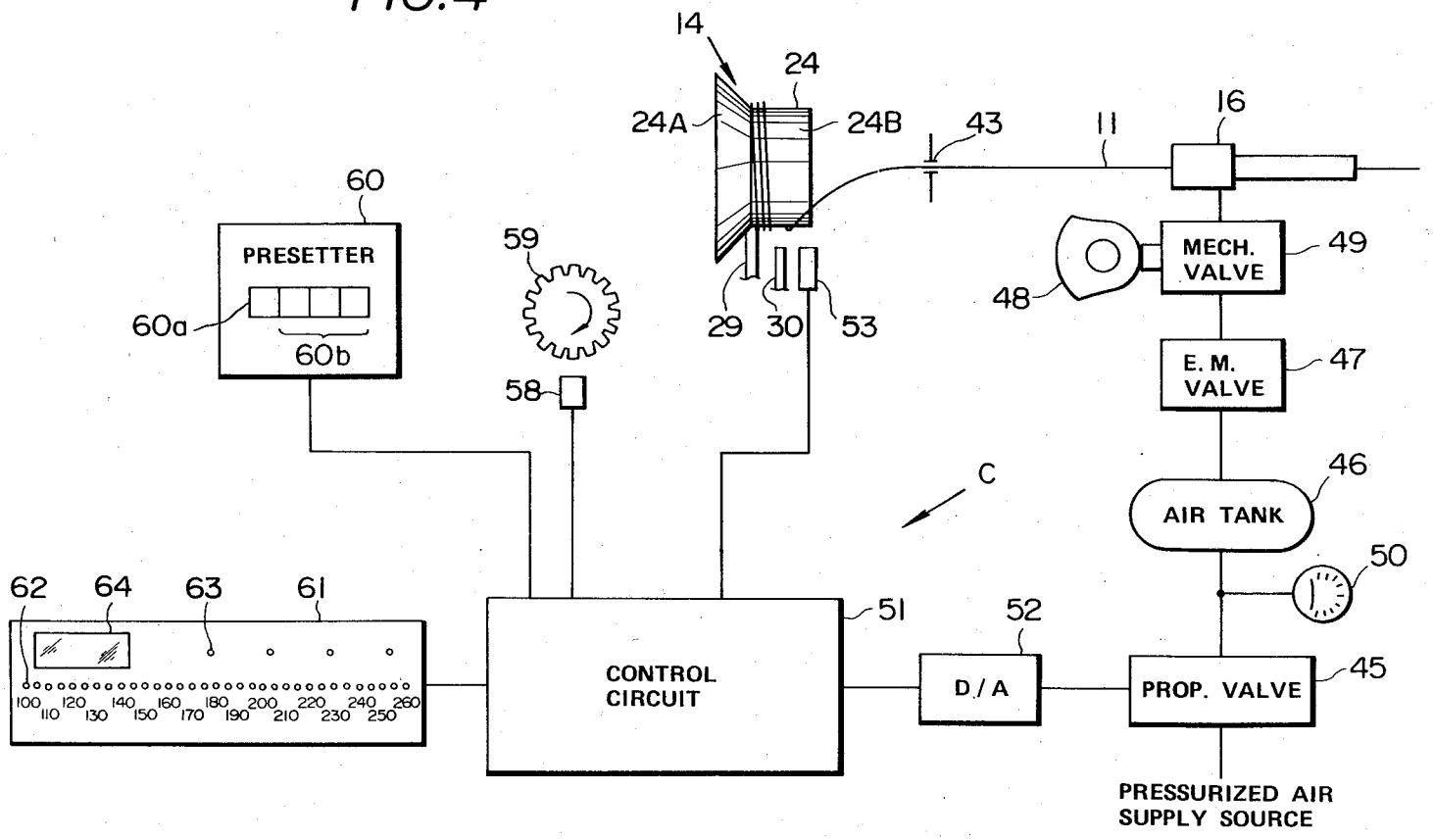
FIG. 4 is a schematic illustration of an essential part of the loom of FIG. 1, showing a weft picking control system for the loom.

The thus arranged loom is provided with a control system C for controlling air pressure to be supplied to the main nozzle 16 as shown in FIG. 4. Referring to FIG. 4, the main nozzle 16 is supplied with pressurized air from a pressurized air supply source through an electric signal-air pressure proportion valve 45, an air tank 46, an electromagnetic valve 47, and a mechanical valve 49. The electric signal-air pressure proportion valve 45 is adapted to function to regulate the pressure of air from the pressurized air supply source to a level in proportion to an electric signal input thereto. The air tank 46 is adapted to detain an amount of air required for about one weft picking. The electromagnetic valve 47 is so adapted as to be open upon closing of a starting preparation switch (not shown) of the loom and to be close upon stopping of the loom. The mechanical valve 49 is so adapted as to be open during a predetermined time period, for example, the weft picking time period of a weaving cycle of the loom. It will be understood that the valves 45, 47, 49 are so arranged that pressurized air from the pressurized air supply source can flow therethrough when they are open. Additionally, a pressure gauge 50 is disposed between the valve 45 and the air tank 46.

A control circuit 51 forming part of the control system C is adapted to output digital signals which are to be converted to analog signals by a D/A converter 52, the analog signals being input to the electric signal-air pressure proportion valve 45. Input to the control circuit 51 are signals from a weft wind-off detector 53, from an angle sensor 58, and from a presetter 60. Additionally, a signal from a proximity switch (not shown) is also input to the control circuit 51, which switch is adapted to produce a signal per one rotation of the loom main shaft. The wind-off detector 53 is adapted to detect the passage of the weft yarn 11 wound off from the drum 24 at the time of weft picking.

Figure 5:
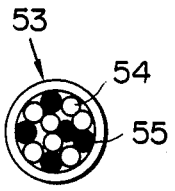
FIG. 5 is an enlarged plan view of the tip end of the weft wind-off detector used in the loom of FIG. 2.
Figure 6:
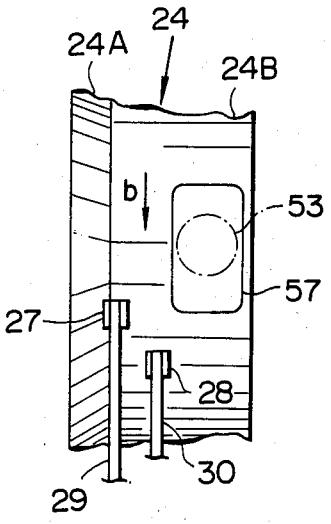
FIG. 6 is a fragmentary front view of a weft storage device drum in connection with the weft wind-off detector of FIG. 5.
Figure 7:
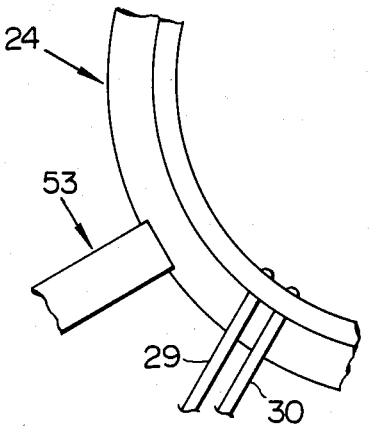
FIG. 7 is a fragmentary side view of the drum of FIG. 6 in connection with the weft wind-off detector.

As shown in FIGS. 5 to 7, the wind-off detector 53 includes a bundle of optical fibers some of which have a light casting face 54 from which light is casted and the others having a light receiving face 55 through which light enters the optical fiber as shown in FIG. 5. As shown in FIGS. 6 and 7, the wind-off detector 53 is so disposed that the light casting and receiving faces 54, 55 spacedly face to a rectangular section 57 on the surface of the detaining section 24B of the weft storage drum 24, the rectangular section 57 being located on the side of the main nozzle 16 relative to the hole 28 and immediately on the upstream side of the holes 27, 28 in a direction (indicated by the arrow b) in which the weft yarn 11 is wound off. It will be understood that the engaging pins 29, 30 are insertable into the holes 27, 28, respectively. The wind-off detector 53 is securely supported to a bracket 56 fixed to the gear box 20 as shown in FIGS. 2 and 3. An extension of the axis of the weft wind-off detectior 53 intersects the axis of the drum 24 at right angles. In this embodiment, the drum 24 is made of aluminum and covered with ceramic coating formed by flame spraying, in which the above-mentioned rectangular section 57 is formed by removing the ceramic coating thereby to expose the face of aluminum, the exposed aluminum face being then buffed to obtain a mirror face. The ceramic coating is for the purpose of preventing the slippage of the weft yarn 11 on the surface of the drum 24.

Thus, light casted from the light casting face 54 of the optical fiber is reflected on the mirror face of the rectangular section 57 and enters through the light receiving face 55 back to the optical fiber. However, when the weft yarn 11 passes through between the mirror face of the rectangular section 57 and the light casting and receiving faces 54, 55 upon the weft yarn 11 being wound off from the drum weft detaining section 24B, light is interrupted to reduce the amount of light entering the optical fiber, thereby detecting the passage of the weft yarn 11. Here, assuming that the weft yarn 11 is being wound four times on the drum 24 as an amount corresponding to one weft picking, a detection signal is obtained per one time wind-off of the weft yarn 11 on the drum 24, so that four detection signals (first, second, third and fourth signals) are obtained until the weft picking terminates. It is to be noted that one of the four detection signals is selected to be used as a wind-off signal for control, the wind-off signal being to be input through the I/O device 68 to the control circuit 51. The angle sensor 58 is located facing a rotatable member 59 which rotates in timed relation to the loom main shaft and provided at its periphery with three hundreds and sixty projections. The angle sensor 58 is adapted to sense the passage of each projection of the rotatable member 59 to detect the rotation angle of the loom main shaft (referred hereinafter to "main shaft angle"), in which a count-up of 1° is made upon sensing of each projection of the rotatable member 59 and in which the output corresponding to 0° is made subsequently to the output corresponding to 359°. The presetter 60 is adapted to preset the information required for the control circuit 51, and includes a binary switch **60*a* by which hexadecimal input may possibly to be made, and three decimal switches 60*b*** and the like.

A timing displaying device 61 is adapted to display the main shaft angle when the wind-off of the weft yarn 11 has been detected. The timing displaying device 61 includes a predetermined number of light emitting diodes 62 which are located in a row along an angular scale formed on the device 61, in which the light emitting diode 62 corresponding to the main shaft angle emits light under the action of the signal from the control circuit 51. In this case, the light emitting diodes 62 are located at intervals of 5°, so that the light emitting diode 62 in the angular position near the measured value emits light. The reference numeral 63 designates four light emitting diodes which are adapted to indicate the fact that any of the first, second, third, and fourth detection signals from the weft wind-off detector 53 is used as the wind-off signal for control. Each light emitting diode 63 is disposed corresponding to an approximate angular position of the main shaft angle at which each wind-off of the weft yarn 11 from the drum 24 is carried out. The displaying device 61 is also provided with a digital display section 64 for displaying air pressure supplied to the main nozzle 16 or digital output corresponding to the digital signal supplied to the D/A converter 52. Accordingly, the control circuit 51 accomplishes predetermined operations in accordance with the control inputs from the weft wind-off detector 53, the angle sensor 58, and the presetter 60, so that outputting is made to the D/A converter 52 and the displaying device 61 in order to carry out the controlling of the air pressure to be supplied to the main nozzle 16, while displaying a predetermined matter.

Figure 8:
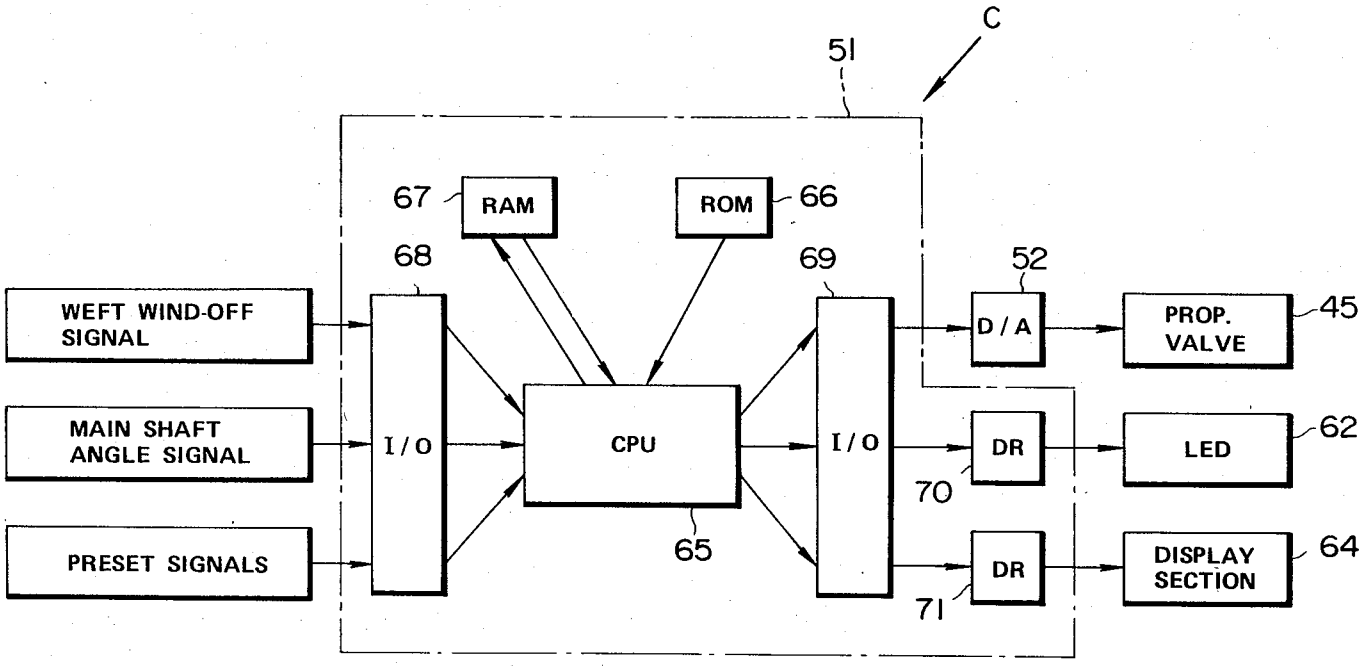
FIG. 8 is a block diagram of a hardware arrangement of a control circuit forming part of the control system of FIG. 4.

As shown in FIG. 8, the control circuit 51 includes a CPU 65, a ROM 66, a RAM 67, I/O (input and output) devices 68, 69, and drivers 70, 71. Accordingly, read through the I/O device 68 in the CPU 61 are the wind-off signal from the weft wind-off detector 53, a signal (representative of the main shaft angle T) from the angle sensor 58, and a signal (representative of a standard angle set value To), a signal (representative of an allowable limit set value LM), and a signal (representative of an initial pressure set value V of air to be supplied to the main nozzle 16) from the presetter 60. Necessary data is written into the RAM 67 and read out from the RAM 67 in accordance with the program of the ROM 66, and is output to the D/A converter 52 through the I/O device 69. Additionally, the outputting is made through the I/O device 69 to the light emitting diodes 62 for a timing display and to the display section 64 for air pressure digital display.

The manner of operation of the loom provided with the control system C will be discussed hereinafter with reference to FIGS. 9A to 9C.

Figure 9A:
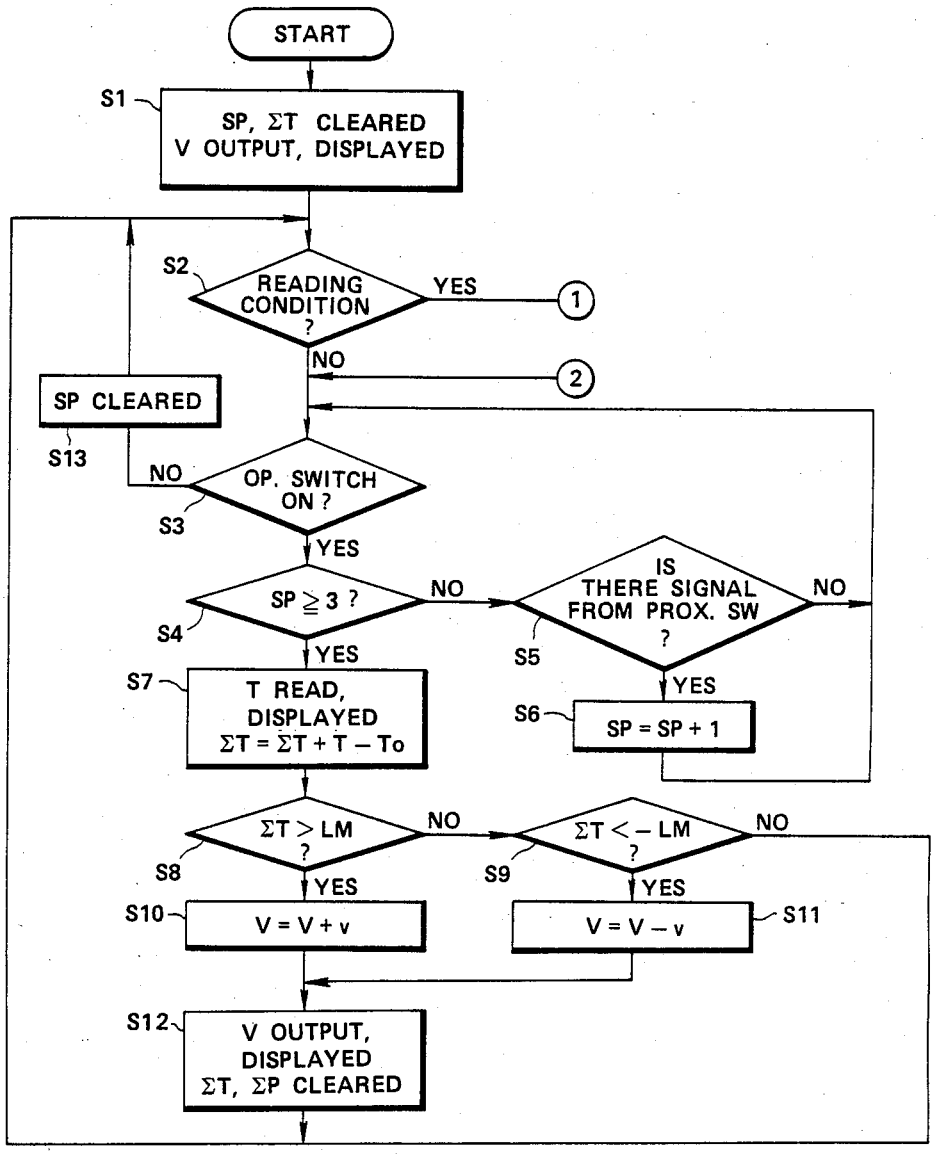
FIGS. 9A, 9B and 9C are flow charts showing the procedure of control of the control system of FIG. 4.
Figure 9B:
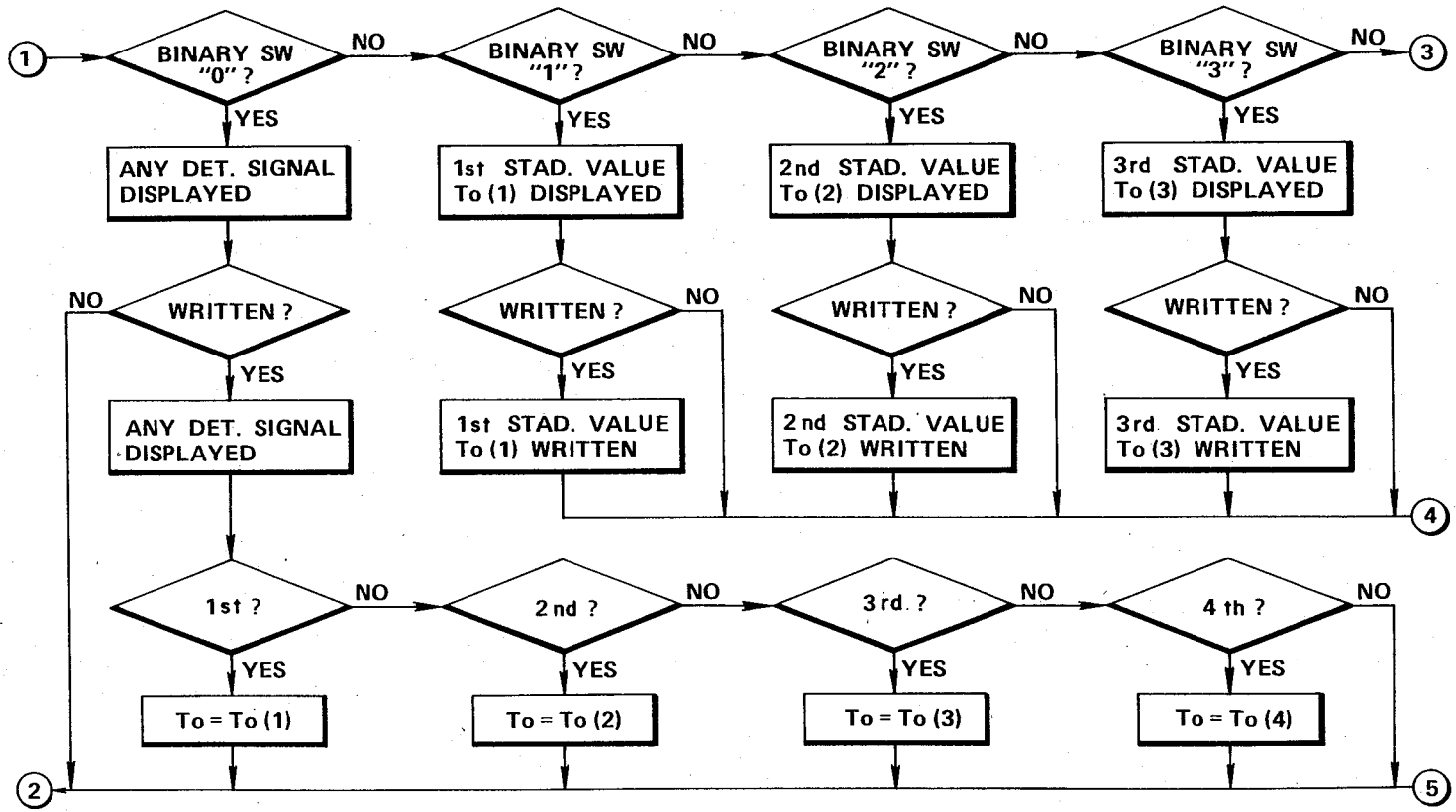
Figure 9C:
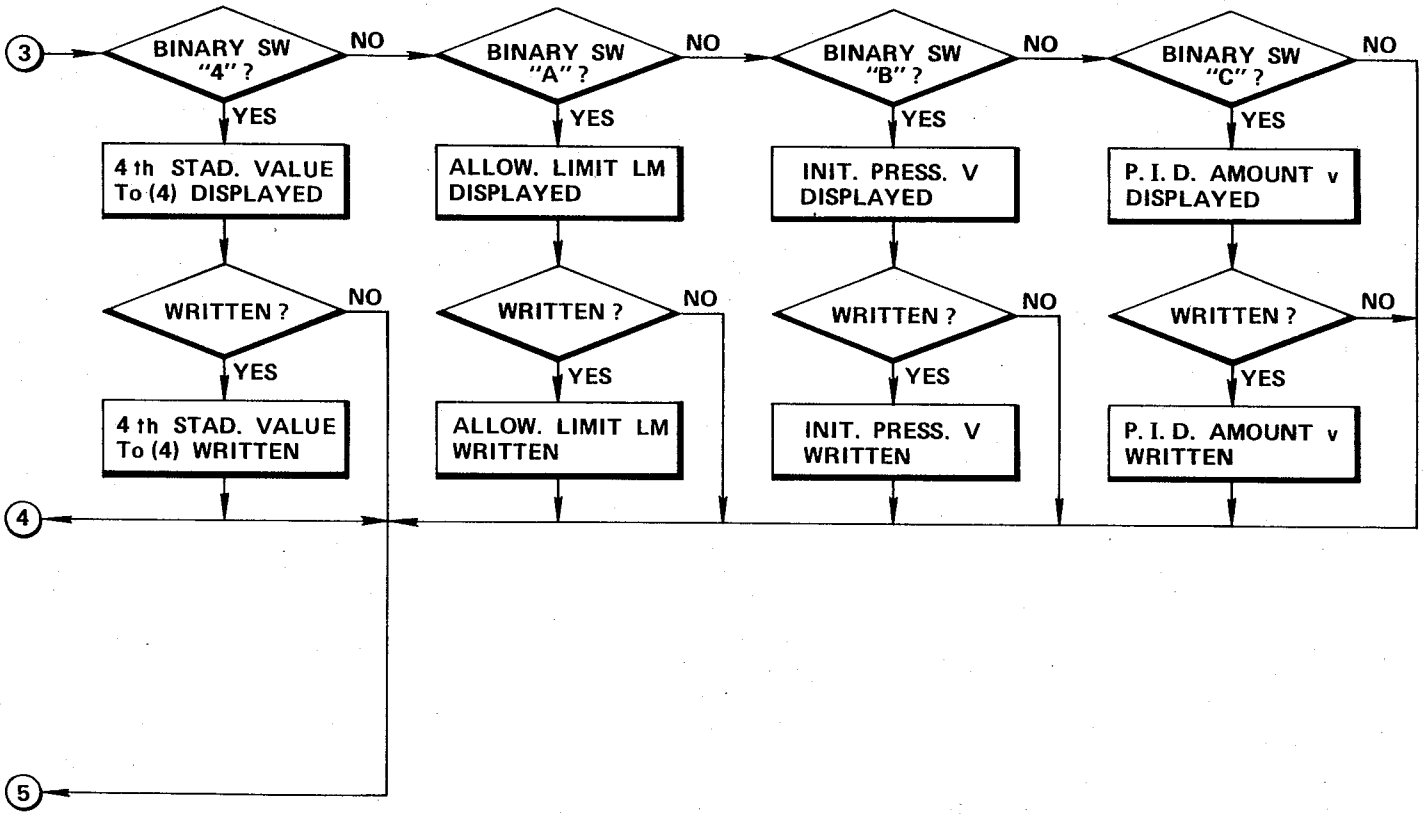

First, when the loom is electrically connected to an electric source, the pick number SP from the starting of loom operation and an accumulated value ΣT discussed after are cleared, and a previously set voltage value corresponding to the output of the D/A converter 52 is displayed in the display section 64 for air pressure digital display (See step S1 of the flow chart in FIG. 9A). Here, the voltage value is set corresponding to the value of air pressure to be supplied to the main nozzle 16.

Subsequently, a determination is made as to whether a reading condition (in which reading is made) of the information from the presetter 60 has been reached (a reading switch for accomplishing reading operation: ON) or not (See a step S2). In the case where various conditions are newly set or changed in the reading condition, such conditions are input through the presetter 60 in accordance with the flow charts in the FIGS. 9A and 9B. More specifically, in case where the binary switch 60*a* of the presetter 60 is "0" in which a setting is to be made as to the selection of any of the four winding-off frequency times of the weft yarn 11, a determination is made as to whether a new value is to be written (the writting switch: ON) or not after the present selection in the winding-off frequency is displayed. In the case when a new valve is being written, the new value set by the three decimal switches 60*b* is written in the RAM 67 to be memorized. That is, in order to set the selection of one of the winding-off frequency times, the binary switch 60*b* is set at "0"; the decimal switches 60*b* are set at "004" in case of selecting the fourth winding-off of the weft yarn 11; and the writing switch is switched ON. By this, the standard angle To is set at a previous value in accordance with the selection in winding-off frequency. In order to change this, the binary switch 60*a* is set at "4"; the decimal switches 60*b* are set, for example, at "230" representative of an angle; and the writting switch is switched ON.

In order to set the allowable limit LM, it is sufficient that the binary switch 60*a* is set at "A"; the decimal switches 60*b* are set, for example, at "100"; and the writting switch is switched ON. In order to set the initial pressure valve V, the binary switch 60*a* is set at "B"; the pressure valve V is set by the decimal switches 60*b;* and the writting switch is switched ON. Additionally, in order to set a pressure increasing or decreasing amount v, it is sufficient that the binary switch 60*a* is set at "C"; the value of the pressure increasing or decreasing amount v is set by the decimal switches 60*b;* and the writting switch is switched ON.

Subsequently, when an operation switch (by which the loom operates) of the loom is switched ON, the pick number SP from the loom operation starting is judged (See steps S3 and S4). Until the pick number SP has reached two, a determination is made as to whether there is a signal from the proximity switch or not (See a step S5). In the case where there is the signal, the pick number SP is counted up (See a step S6), standing ready to become three. Thus, until the pick number SP has reached two, the pressure control and reading the informations therefor are not carried out, merely standing ready for stable revolution of the loom. At this time, ejection of air from the main nozzle 16 is carried out under the initial pressure V of air controlled by the electric signal-air pressure proportion valve 45.

After the pick number SP has reached three, the signal representative of the actual main shaft angle T from the angle sensor 58 is read at a point in time at which a predetermined detection signal (for example, the fourth detection signal) of the four detection signals from the weft wind-off detector 53 is input when the weft yarn 11 is wound off from the drum 24 during weft picking. Then, a subtraction of the standard value To from the actual main shaft angle T is made to obtain a difference (T−To), and an accumulated value ΣT of such differences (T−To) is calculated (See a step S7). Here, the main shaft angle T is visualized by causing the light emitting diode 62 corresponding thereto to emit light.

Next, a determination is made as to whether the accumulated value ΣT of the differences (T−To) exceeds the allowable limit on the plus or minus side (for example, ±100) or not (See steps S8 and S9). In case of exceeding the plus side allowable limit, the pressure increasing or decreasing amount v is added to the present pressure value (or the previously set initial value) V thereby to set a new pressure value V (See a step S10). In the case of where the minus side allowable limit is exceeded, the pressure increasing or decreasing amount v is subtracted from the present pressure value V and a new pressure value is set (See a step 11). The thus newly set pressure value V is output to the D/A converter 52 and displayed in the display section 64. Simultaneously, ΣT is cleared (See a step 12).

Thus, in the case where the accumulated value ΣT of the differences between the detected value T and the standard value To exceeds the plus side allowable limit LM, the weft picking time period is judged to be too long, so that the pressure V supplied to the main nozzle 16 is raised thereby to enlarge the traction force applied to the weft yarn 11, thus regulating the weft picking time period to a suitable value. To the contrary, in the case where the accumulated value ΣT exceeds the minus side allowable limit LM, the weft picking time period is judged to be too short, so that the pressure V supplied to the main nozzle 16 is lowered thereby to minimize the traction force applied to the weft yarn 11, thus regulating the weft picking time period to the suitable value. In the case where the accumulated value ΣT is inside the allowable limit, the previous pressure is of course maintained. When the operation switch is switched OFF, the pick number SP from the loom operation starting is cleared and the standing ready condition is made (See a step 13).

Figure 10:
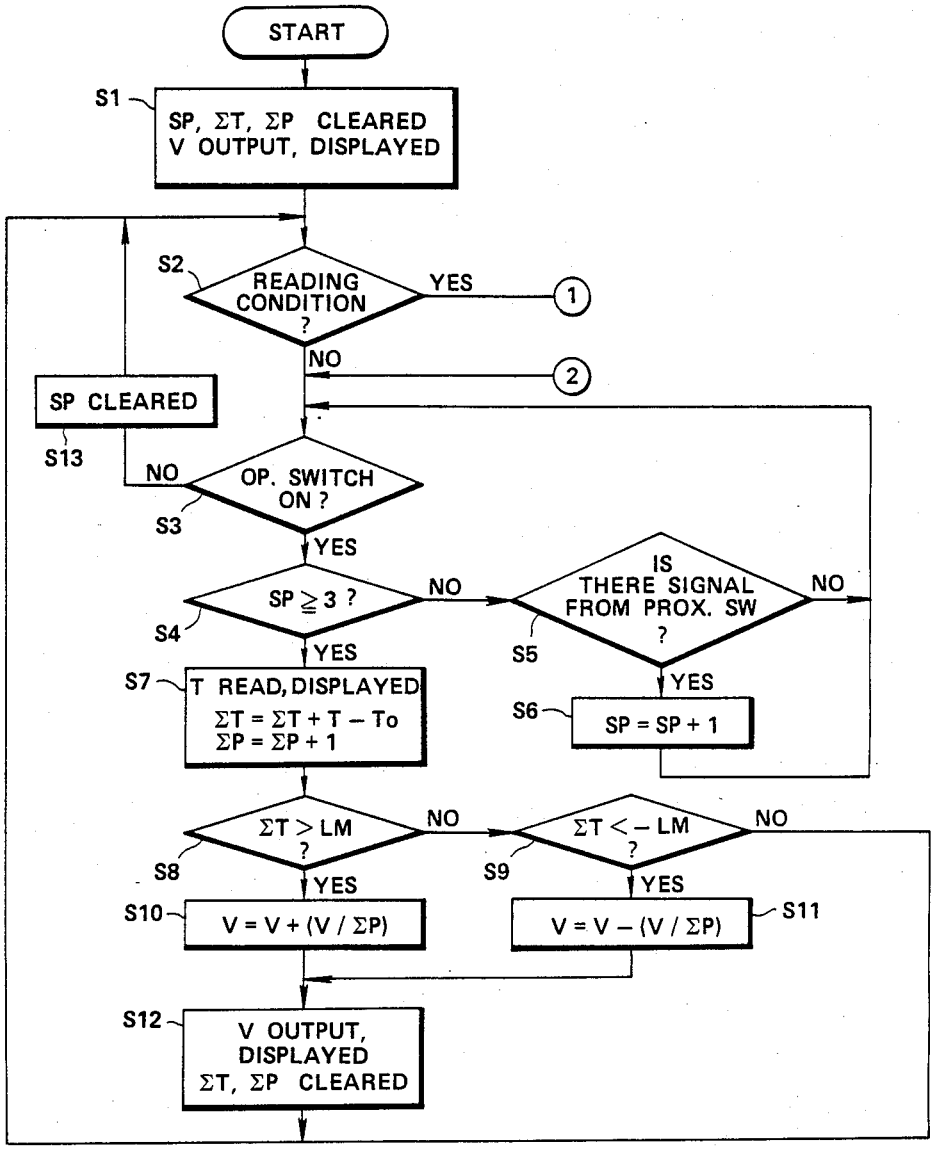
FIG. 10 is a flow chart similar to FIG. 9A but showing the procedure of control of a control system of a second embodiment of the loom in accordance with the present invention.
Figure 11A:
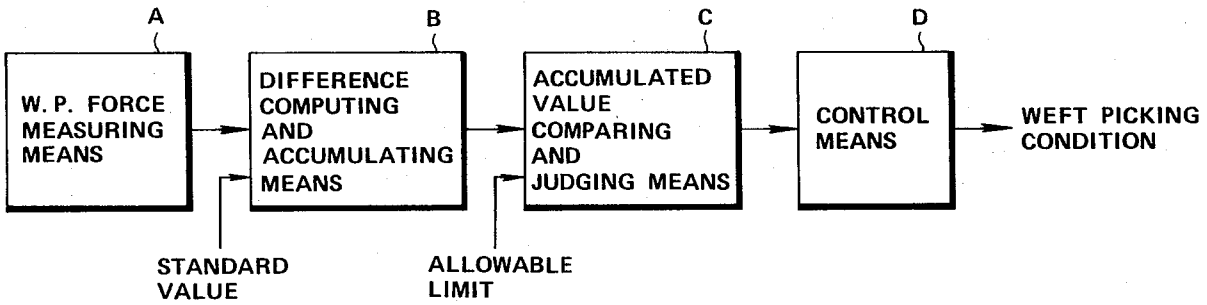
FIG. 11A is a block diagram showing a first aspect of the present invention.
Figure 11B:
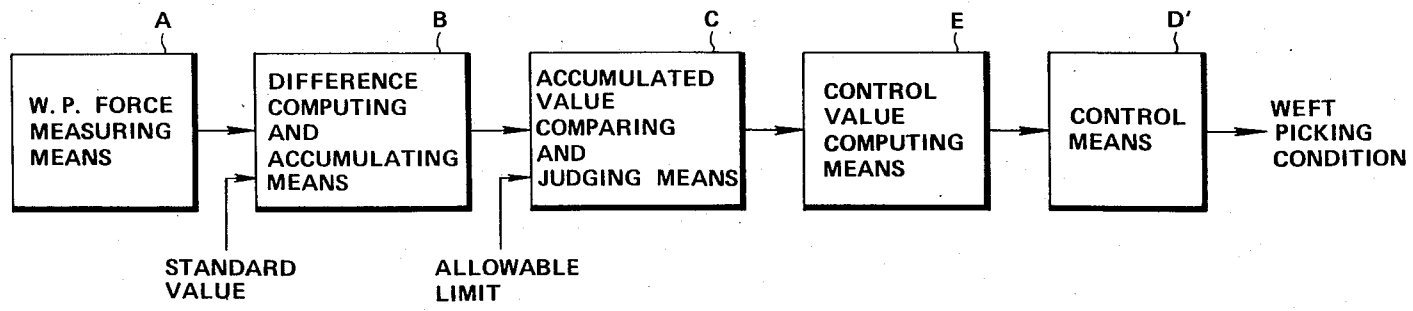
FIG. 11B is a block diagram showing a second aspect of the present invention.

FIG. 10 illustrates the operation of a second embodiment of the loom in accordance with the present invention. This embodiment is similar to the first embodiment shown in FIGS. 1 to 9C with the following exceptions (in the flow chart of FIG. 9A) : (1) a clearing ΣP is added to the step S1; (2) an operation of $\Sigma P = \Sigma P + 1$ is added to the step S7; (3) the operations in the steps S10 and S11 are changed to $V = V \pm V/\Sigma P$; and (4) a clearing of ΣP is added to the step S12. In this connection, the presetting of various values of this embodiment are carried out similarly to the flow charts of FIGS. 9B and 9C with the exception that setting the pressure increasing and decreasing amount v is omitted.

In this embodiment, as indicated in a step S7 of FIG. 10, the signal of the main shaft angle T from the angle sensor 57 is read at a point in time at which the predetermined or fourth detection signal of the four detection signals from the weft wind-off detector 52 is input. Then, the standard value To is subtracted from the main shaft angle value T to obtain a difference (T−To), and an accumulated value of such differences (T−To) is calculated and simultaneously the value of ΣP representative of the pick number from the starting of the accumulation of the differences is increased by one (T−To).

Subsequently, as indicated in steps S8 and S9, a determination is made as to whether the accumulated value ΣT (for example, ±100) of the differences (T−To) exceeds the allowable limit on the plus or minus side or not. In the case where the plus side allowable limit is exceeded as indicated in a step S10, the present pressure value V is divided by the pick number P (for example, 10) before exceeding the allowable limit to obtain a value which is in turn added to the present pressure value V, thus setting a new pressure value V. In the case where the minus side allowable limit as indicated in a step S11, the present pressure value V is divided by the pick number ΣP reached before exceeding the allowable limit to obtain a value which is in turn subtracted from the present pressure value V, thus setting a new pressure value V. Next, the thus newly set pressure value V is output to the D/A converter 52 and displayed in digital in the display section 64.

Thus, in the case where the accumulated value ΣT of the difference between the detected value T and the standard value To exceeds the plus side allowable limit LM, the weft picking time period is judged to be too long, so that the pressure V of air to be supplied to the main nozzle 16 is raised by an amount corresponding to the pick number required before exceeding the allowable limit, thereby enlarging the traction force of air applied to the weft yarn 11, thus regulating the weft picking time period at a suitable value. To the contrary, in case where the accumulated value MT exceeds the minus side allowable limit LM, the weft picking time period is judged to be too short, so that the pressure V of air to be supplied to the main nozzle 16 is lowered by an amount corresponding to the pick number required before exceeding the allowable limit thereby to minimize the traction force applied to the weft yarn 11, thus regulating the weft picking time period at a suitable value.

It will be understood that, in this embodiment, control of the air pressure to be supplied to the main nozzle 16 is accomplished in proportion to the magnitude of the difference between the time period required for weft picking and the standard value (time period), thereby improving the follow-up ability of the control.

While the time period required for weft picking has been shown and described to be measured as a force required for weft picking in which the timing at which a predetermined condition has been reached in weft picking or at the termination of weft picking is detected, it will be understood that a tension of the weft yarn may be measured as the force required for weft picking in which the tension of the weft yarn is, for example, measured at the time of weft picking termination at which the weft yarn 11 is brought into engagement with the engaging pin 29 in connection with the weft storage device drum 24, by using a strain gauge (not shown) attached to engaging pin 29, the strain gauge detecting the deflection of the engaging pin.

Although control of the force required for weft picking has been shown and described as being accomplished by regulating the air pressure to be supplied to the main nozzle, it will be understood that the same control may be accomplished by so controlling the revolution speed that the time period required for weft picking occupies a constant fraction or rate in a weaving cycle, in which increasing the revolution speed of the loom main shaft shortens the weft picking time period while decreasing the revolution speed prolongs the weft picking time period. Otherwise, in the case of an air jet loom, the same control may be accomplished by controlling the air pressure to be supplied to and the air ejection time of auxiliary nozzles (not shown) which are arranged in a row along a weft passage through which the weft yarn travels in weft picking.

What is claimed is:

1. A fluid jet loom comprising:

a weft inserting nozzle by which a weft yarn is picked under influence of a fluid supplied thereto;

means for measuring a force applied to said weft yarn to accomplish a weft picking;

means for computing differences each between said force and a standard value and for accumulating said differences to obtain an accumulated value;

means for comparing said accumulated value with an allowable limit and for judging that said accumulated value exceeds said allowable limit; and means for controllably changing a condition under which said weft yarn is picked, upon judgement of said accumulated value exceeding said allowable limit.

2. A fluid jet loom as claimed in claim 1, wherein said condition controllably changing means includes means for controllaby changing rate of a fraction of time required for said weft picking, occupied in a weaving cycle of the loom, upon said judgement.

3. A fluid jet loom as claimed in claim 2, wherein said time fraction rate controllably changing means includes means for controllably changing a parameter of said fluid to be supplied to said weft inserting nozzle, upon said judgement.

4. A fluid jet loom as claimed in claim 2, wherein said time fraction rate controllably changing means includes means for controllably changing revolution speed of a main shaft of the loom.

5. A fluid jet loom as claimed in claim 2, wherein said force measuring means includes means for measuring a time period required for said weft picking, in which said differences computing and accumulating means includes means for computing differences each between said time period and a standard value and for accumulating said differences to obtain an accumulated value.

6. A fluid jet loom as claimed in claim 2 wherein said condition controllably changing means includes means for carrying out, upon said judgement an operation in accordance with the following equation:

$$V_1 = V_2 \pm V_2/\Sigma P$$

where $V_1$ is a first control value representative of said force; $V_2$ is a second control value representative of said force and used earlier in time than said first control value; and ΣP is a pick number made from starting of said differences accumulating, and means for controllably changing said condition in accordance with said first control value.

7. A fluid jet loom as claimed in claim 6 wherein said force measuring means includes means for measuring a time period required for said weft picking, in which said differences computing and accumulating means includes means for computing differences each between said time period and a standard value and for accumulating said differences to obtain an accumulated value.

8. A fluid jet loom as claimed in claim 6 wherein said time fraction rate controllably changing means includes means for controllably changing a parameter of said fluid to be supplied to said weft inserting nozzle, upon said judgement.

9. A fluid jet loom as claimed in claim 6 wherein said time fraction rate controllably changing means includes means for controllably changing revolution speed of a main shaft of the loom.

10. A fluid jet loom as claimed in claim 1, wherein said condition controllably changing means includes means for carrying out, upon said judgement an operation in accordance with the following equation:

$$V_1 = V_2 \pm V_2/\Sigma P$$

where $V_1$ is a first control value representative of said force; $V_2$ is a second control value representative of said force and used earlier in time than said first control value; and $\Sigma P$ is a pick number made from starting of said differences accumulating, and means for controllably changing said condition in accordance with said first control value.

11. A fluid jet loom as claimed in claim 10, wherein said time fraction rate controllably changing means includes means for controllably changing a parameter of said fluid to be supplied to said weft inserting nozzle, upon said judgement.

12. A fluid jet loom as claimed in claim 10, wherein said time fraction rate controllably changing means includes means for controllably changing revolution speed of a main shaft of the loom.

13. A fluid jet loom as claimed in claim 10 wherein said force measuring means includes means for measuring a time period required for said weft picking, in which said differences computing and accumulating means includes means for computing differences each between said time period and a standard value and for accumulating said differences to obtain an accumulated value.

14. A fluid jet loom as claimed in claim 1, wherein said force measuring means includes means for measuring a time period required for said weft picking, in which said differences computing and accumulating means includes means for computing differences each between said time period and a standard value and for accumulating said differences to obtain an accumulated value.

15. A fluid jet loom as claimed in claim 14 wherein said time fraction rate controllably changing means includes means for controllably changing a parameter of said fluid to be supplied to said weft inserting nozzle, upon said judgement.

16. A fluid jet loom as claimed in claim 14 wherein said time fraction rate controllably changing means includes means for controllably changing revolution speed of a main shaft of the loom.

17. A fluid jet loom as claimed in claim 14 wherein said accumulated value comparing and judging means includes means for comparing said accumulated value with first and second allowable limits and for judging that said accumulated value exceeds one of said first and second allowable limits, in which said time fraction rate changing means includes means for controllably decreasing said time period upon judgement of said accumulated value exceeding said first allowable limit and increasing said time period upon judgement of said accumulated value exceeding said second allowable limit.

18. A fluid jet loom as claimed in claim 17 wherein said time period controllably decreasing and increasing means includes means for increasing pressure of said fluid to be supplied to said weft inserting nozzle upon judgement of said accumulated value exceeding said first allowable limit and decreasing said pressure of said fluid upon judgement of said accumulated value exceeding said second allowable limit.

19. A fluid jet loom as claimed in claim 18, further comprising weft storage means for storing a predetermined length of said weft yarn prior to said weft picking, said weft storage means including a drum on which said weft yarn is wound to be stored.

20. A fluid jet loom as claimed in claim 19 wherein said time period measuring means includes a weft wind-off detector constructed and arranged to detect passage of said weft yarn when said weft yarn is wound off from said drum.

21. A fluid jet loom as claimed in claim 20 wherein said weft wind-off detector includes a bunch of optical fibers having light casting and receiving faces which spacedly face to the surface of said drum, in which said drum being formed with a mirror face on the surface of said drum to which mirror face said light casting and receiving faces are faceable.

* * * * *